US011193667B2

(12) United States Patent
Hou et al.

(10) Patent No.: US 11,193,667 B2
(45) Date of Patent: Dec. 7, 2021

(54) LIGHTING APPARATUS

(71) Applicant: XIAMEN LEEDARSON LIGHTING CO., LTD, Fujian (CN)

(72) Inventors: Shouqiang Hou, Fujian (CN); Xiaoliang Wen, Fujian (CN); Anyong Liu, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/105,452

(22) Filed: Nov. 25, 2020

(65) Prior Publication Data

US 2021/0156558 A1 May 27, 2021

(30) Foreign Application Priority Data

Nov. 27, 2019 (CN) ..... 201922081715.5

(51) Int. Cl.

| | |
|---|---|
| ***F21V 33/00*** | (2006.01) |
| ***F21V 5/04*** | (2006.01) |
| ***F21V 3/02*** | (2006.01) |
| ***F21Y 115/10*** | (2016.01) |

(52) U.S. Cl.

CPC ..... *F21V 33/0056* (2013.01); *F21V 3/02* (2013.01); *F21V 5/04* (2013.01); *F21Y 2115/10* (2016.08)

(58) Field of Classification Search

CPC ..... F21V 33/0056; F21V 3/02; F21V 5/04; F21Y 2115/10

See application file for complete search history.

(56) References Cited

U.S. PATENT DOCUMENTS

| | | | | |
|---|---|---|---|---|
| 2004/0175014 | A1* | 9/2004 | Liu | H04R 1/028 381/386 |
| 2007/0064433 | A1* | 3/2007 | Wright | F21V 33/0056 362/364 |
| 2007/0222631 | A1* | 9/2007 | Haase | G08B 7/06 340/691.5 |
| 2008/0143495 | A1* | 6/2008 | Haase | F21K 9/00 340/326 |
| 2009/0207607 | A1* | 8/2009 | Haase | G08B 7/06 362/234 |
| 2011/0255711 | A1* | 10/2011 | Ivey | F21V 33/0056 381/104 |
| 2014/0355246 | A1* | 12/2014 | Yotsumoto | F21V 23/006 362/86 |
| 2015/0049461 | A1* | 2/2015 | Yotsumoto | F21V 7/0058 362/86 |
| 2017/0211750 | A1* | 7/2017 | Yotsumoto | F21K 9/237 |

* cited by examiner

*Primary Examiner* — Anabel Ton

(74) *Attorney, Agent, or Firm* — Chun-Ming Shih; Lanway IPR Services

(57) ABSTRACT

A lighting apparatus includes a light passing cover, a base plate, a speaker module, a light source module and a lens module. The light passing cover has a dome shape structure. The dome shape structure has a neck-in edge and neck part. The neck part has a smaller diameter than the neck-in edge. The first fixing unit is placed on the neck part. The second fixing unit is fixed to the first fixing unit. The bottom surface of the speaker module is fixed on a center position of the base plate. The top surface of the speaker module has an audio output end.

19 Claims, 10 Drawing Sheets

LIGHTING APPARATUS

FIELD

The present invention is related to a lighting apparatus, and more particularly related to a lighting apparatus with a function module.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

People look for adding functions to light devices. When light devices like downlight devices, ceiling lights, spotlights are fixed to a ceiling or a wall, such devices receive power supply.

It is beneficial to find a flexible way to add functions to light devices. People look for adding functions to light devices. When light devices like downlight devices, ceiling lights, spotlights are fixed to a ceiling or a wall, such devices receive power supply.

It is beneficial to find a flexible way to add functions to light devices. People look for adding functions to light devices. When light devices like downlight devices, ceiling lights, spotlights are fixed to a ceiling or a wall, such devices receive power supply.

It is beneficial to find a flexible way to add functions to light devices. People look for adding functions to light devices. When light devices like downlight devices, ceiling lights, spotlights are fixed to a ceiling or a wall, such devices receive power supply.

It is beneficial to find a flexible way to add functions to light devices.

SUMMARY

In some embodiments, a lighting apparatus includes a light passing cover, a base plate, a speaker module, a light source module and a lens module.

The light passing cover has a dome shape structure.

The dome shape structure has a neck-in edge and neck part. The neck part has a smaller diameter than the neck-in edge.

The first fixing unit is placed on the neck part.

The base plate has a ring area and a second fixing unit.

The second fixing unit is fixed to the first fixing unit.

The speaker module has a cylinder structure with a bottom surface and a top surface.

The bottom surface of the speaker module is fixed on a center position of the base plate.

The top surface has an audio output end.

The light source module with multiple LED modules placed on the ring area of the base plate.

The multiple LED modules is placed surrounding the speaker module.

The lens module includes multiple diffusing lenses respectively covering the multiple LED modules for diffusing a light of the multiple LED modules before the light passing through the light passing cover.

In some embodiments, the light passing cover has a central opening on the dome structure.

The top surface of the speaker module is facing to the central opening of the light passing cover.

In some embodiments, a speaker cover is fixed to the central opening of the light passing cover facing to the audio output end of the speaker module.

In some embodiments, a motion sensor is attached to the speaker module.

The speaker module stops audio output if the motion sensor detects no person exists nearby over a predetermined time period.

In some embodiments, the speaker module automatically starts the audio output if the motion sensor detects a person is nearby.

In some embodiments, there is a first controller attached to the base plate for controlling the multiple LED modules and a second controller placed in the speaker module for selectively controlling the multiple LED modules.

In some embodiments, the second controller receives an external command from an external light device to control the multiple LED modules to synchronize with the external light device.

In some embodiments, the external light device has a same structure as the lighting apparatus.

In some embodiments, the light passing cover is a mesh structure, the light of the multiple LED module escape from the mesh structure.

In some embodiments, there are third fixing units disposed to the bottom surface of the speaker module to fix the speaker module to the base plate.

In some embodiments, the speaker module is fixed to a fixing bracket on an installation platform.

The base plate is attached to the speaker module to indirectly fixing to the installation platform.

In some embodiments, an external power wire transmitting an external power is fixed to the speaker module.

A driver of the speaker module converts the external power to a driver current supplied to the multiple LED modules.

In some embodiments, a driver in the speaker module supplies a driving current to the multiple LED modules.

In some embodiments, an external power is separately supplied to the speaker module and the light source module.

In some embodiments, a driver is fixed on the base plate.

The driver converts an external power to two driving currents respectively supplied to the multiple LED modules and the speaker module.

In some embodiments, the top surface of the speaker module has a second light source for emitting a second light.

In some embodiments, the light of the LED modules rendered on the light passing cover has a first light intensity.

The second light of the second light source renders a second light intensity.

The ratio of the first light intensity to the second light intensity is between 70% to 130%.

In some embodiments, the multiple LED modules are placed on multiple LED light bars.

The LED light bars are attached to the base plate with multiple bar connectors for receiving electricity and structure support fixing to the base plate.

In some embodiments, the base plate has a circular groove for fixing to the bottom surface of the speaker module.

In some embodiments, a support bar has a first end fixed to the installation platform and a second end fixed to the base plate.

The support bar has a U shape structure corresponding to a opposite side of the circular groove.

DETAILED DESCRIPTION

Figure 6:
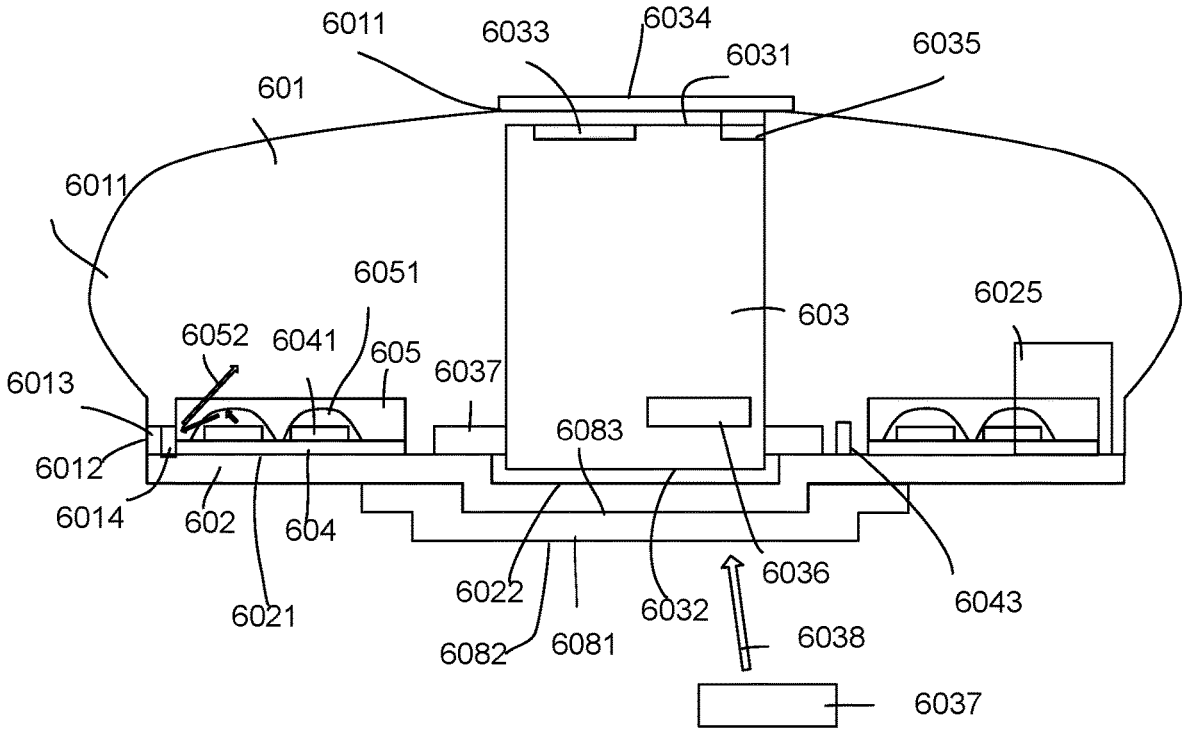
FIG. 6 illustrates another embodiment.

Please refer to FIG. 6, a lighting apparatus includes a light passing cover 601, a base plate 602, a speaker module 603, a light source module 604 and a lens module 605.

The light passing cover 601 has a dome shape structure. The dome shape structure defines a three-dimensional curve surface covering components below the dome shape structure. The light passing cover 601 may be made of transparent plastic material allowing light to pass through.

The dome shape structure 601 has a neck-in edge 6011 and neck part 6012. The neck part 6012 has a smaller diameter than the neck-in edge 6011. Specifically, the neck-in edge 6011 is at peripheral edge with reverse curve shape compared with central area of the light passing cover 601. The neck-in edge 6011 is shrinking gradually to the neck part 6012 and thus has a larger diameter than the neck part 6012.

The first fixing unit 6013 is placed on the neck part 6012.

The base plate 602 has a ring area 6021 and a second fixing unit 6014.

The second fixing unit 6014 is fixed to the first fixing unit 6013. For example, the first fixing unit 6012 is a guiding track allowing the second fixing unit 6014 as a protruding block to move along the guiding track to fix the light passing cover 601 to the base plate 602.

The speaker module 603 has a cylinder structure with a bottom surface 6032 and a top surface 6031.

The bottom surface 6032 of the speaker module 603 is fixed on a center position 6022 of the base plate 602. Specifically, there may be a hollow circular groove as the center position 6022 for fitting the bottom surface 6032 of the speaker module 603.

The top surface 6031 has an audio output end 6033.

The light source module 604 with multiple LED modules 6041 placed on the ring area 6021 of the base plate 602.

The multiple LED modules 6041 are placed surrounding the speaker module 603.

The lens module 605 includes multiple diffusing lenses 6051 respectively covering the multiple LED modules 6041 for diffusing a light 6052 of the multiple LED modules 6041 before the light passing through the light passing cover 601.

Specifically, multiple reflective and refraction surfaces may be arranged for diffusing light of the LED modules 6041 more evenly.

In some embodiments, the light passing cover 601 has a central opening 6011 on the dome structure 601.

The top surface 6031 of the speaker module 603 is facing to the central opening 6011 of the light passing cover 601.

In some embodiments, a speaker cover 6034 is fixed to the central opening 6011 of the light passing cover 601 facing to the audio output end 6033 of the speaker module 60. For example, the speaker cover 6034 may have a mesh structure allowing sounds of the speaker module 603 to pass through.

In some embodiments, a motion sensor 6035 is attached to the speaker module 603.

The speaker module 603 stops audio output if the motion sensor 6035 detects no person exists nearby over a predetermined time period. For example, a second controller 6036 that is coupled to the motion sensor 6035. The motion sensor 6036 may use an infrared sensor, a camera unit or a microwave unit for collecting movement information nearby. The movement information is decoded by the second controller 6036, which may be a processor running a stored program codes or a micro-controller integrated with corresponding circuit logic. The decoded result indicates whether there is a person moving nearby. If there is no one found moving or existed nearby, the second controller 6036 cut off and stop the audio output, e.g. radio program or music streaming to save power.

In some embodiments, the speaker module automatically starts the audio output if the motion sensor detects a person is nearby. Specifically, in such case, the second processor continues or starts automatically to send audio data like music out to the users.

In some embodiments, there is a first controller 6043 attached to the base plate 602 for controlling the multiple LED modules 6041 and a second controller 6036 placed in the speaker module 603 for selectively controlling the multiple LED modules 6041.

In other words, such arrangement allows both the first controller 6043 and the second controller 6036 to control the LED modules 6041. A priority or a set of rules may be defined and stored in the first controller 6043 and/or the second controller 6036 to define when control commands are in a conflict status.

In some embodiments, the second controller 6036 receives an external command 6038 from an external light device 6037 to control the multiple LED modules 6041 to synchronize with the external light device 6037.

In some embodiments, the external light device 6037 has a same structure as the lighting apparatus.

Figure 7:
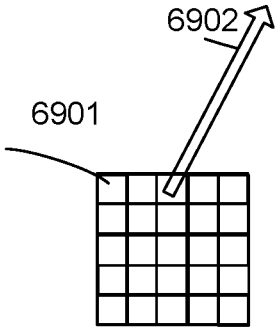
FIG. 7 shows a mesh style light passing cover.

In FIG. 7, the light passing cover is a mesh structure 6901, the light 6902 of the multiple LED module escapes from the mesh structure 6901.

In FIG. 6, there are third fixing units 6037 disposed to the bottom surface 6032 of the speaker module 603 to fix the speaker module 603 to the base plate 602.

Figure 8:
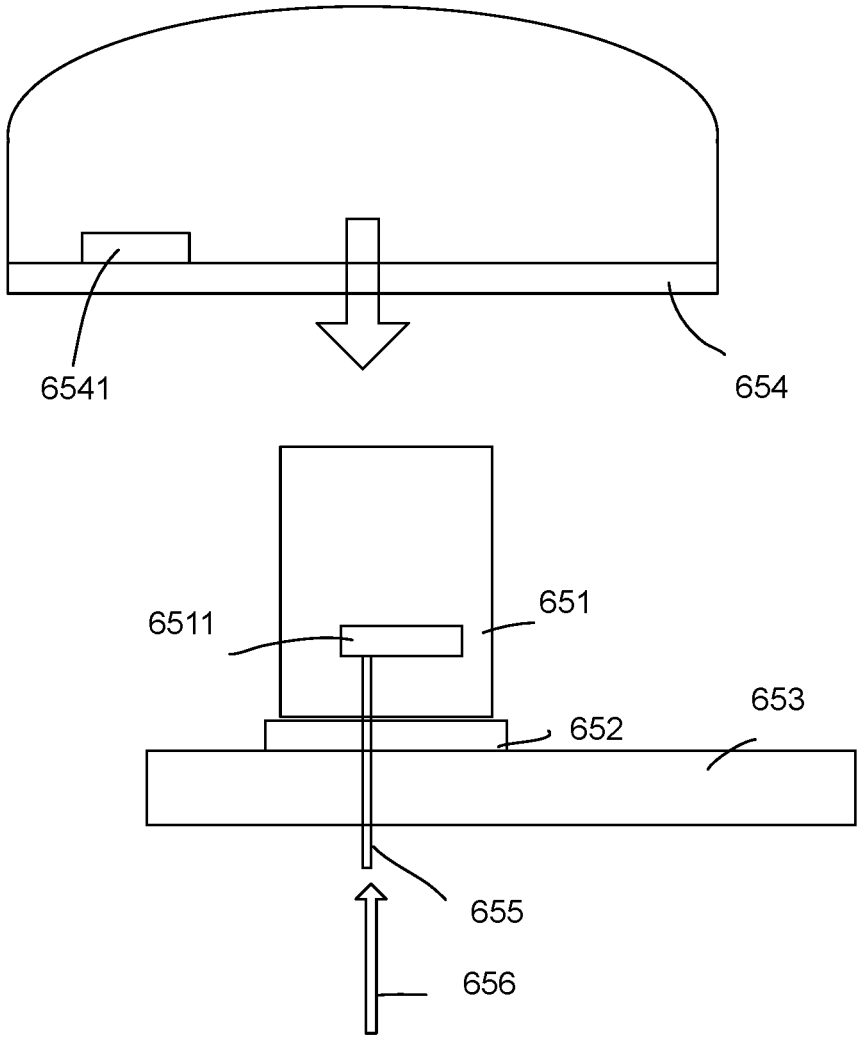
FIG. 8 shows a connection example of components.

In FIG. 8, the speaker module 651 is fixed to a fixing bracket 652 on an installation platform 653, e.g. a ceiling.

The base plate 654 is attached to the speaker module 653 to indirectly fixing to the installation platform 653.

In some embodiments, an external power wire 655 transmitting an external power 656 is fixed to the speaker module 651.

A driver 6511 of the speaker module 651 converts the external power 656 to a driver current supplied to the multiple LED modules 6541, e.g. via a conductive path and electrodes to route the converted driving current to the LED modules 6541.

In some embodiments, a driver in the speaker module supplies a driving current to the multiple LED modules.

Figure 9:
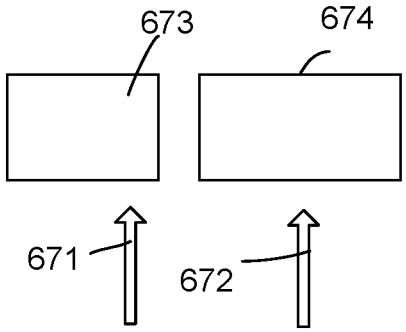
FIG. 9 shows power supplying relation.
Figure 10:
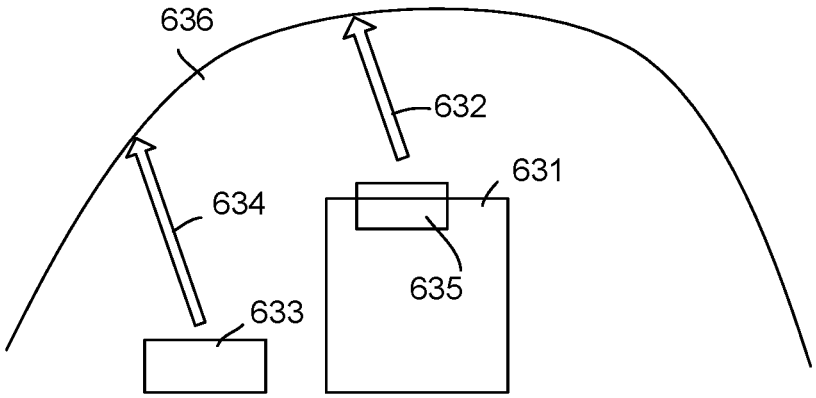
FIG. 10 shows a light intensity control example.

In FIG. 9, an external power 671, 672 is separately supplied to the speaker module 673 and the light source module 674.

In FIG. 6, a driver 6025 is fixed on the base plate 602.

The driver 6025 converts an external power to two driving currents respectively supplied to the multiple LED modules 6041 and the speaker module 603.

In some embodiments, the top surface 631 of the speaker module has a second light source 635 for emitting a second light 632.

In some embodiments, the light 634 of the LED modules 533 rendered on the light passing cover 636 has a first light intensity.

The second light 632 of the second light source 635 renders a second light intensity.

The ratio of the first light intensity to the second light intensity is between 70% to 130%. In other words, the light intensity of the second light source is similar to the light rendered by the LED modules to appear as a single illumination surface. This can be controlled by setting light intensity of the LED modules and the second light source.

Figure 11:
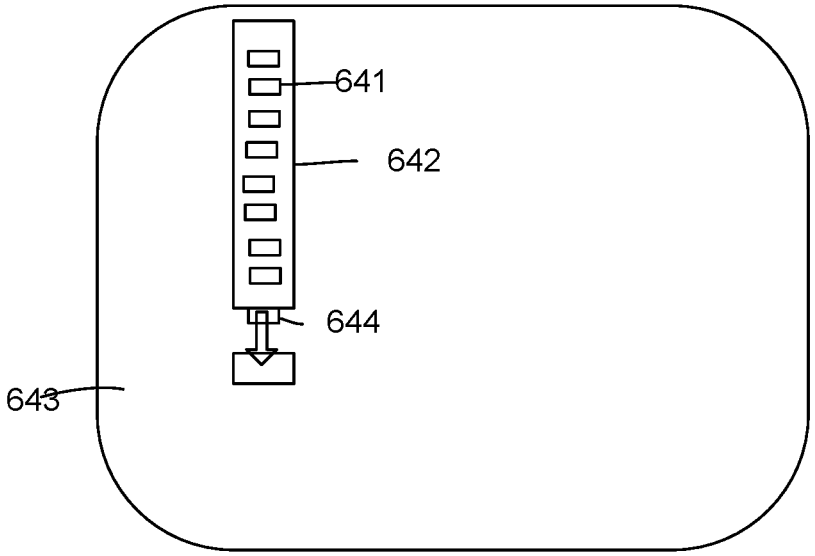
FIG. 11 shows a LED light bar.

In FIG. 11, the multiple LED modules 641 are placed on multiple LED light bars 642.

The LED light bars 642 are attached to the base plate 643 with multiple bar connectors 644 for receiving electricity and structure support fixing to the base plate 643. Such bar connectors may include structure socket and plug structures for both transmitting electricity and also providing structure support for fixing the LED light bar to the base plate.

In FIG. 6, the base plate has a circular groove 6022 for fixing to the bottom surface 6032 of the speaker module 603.

In some embodiments, a support bar 6081 has a first end 6082 fixed to the installation platform, e.g. a ceiling, and a second end 6083 fixed to the base plate 602.

The support bar 6081 has a U shape structure corresponding to an opposite side of the circular groove, e.g. the support bar 6 in FIG. 6.

Figure 1:
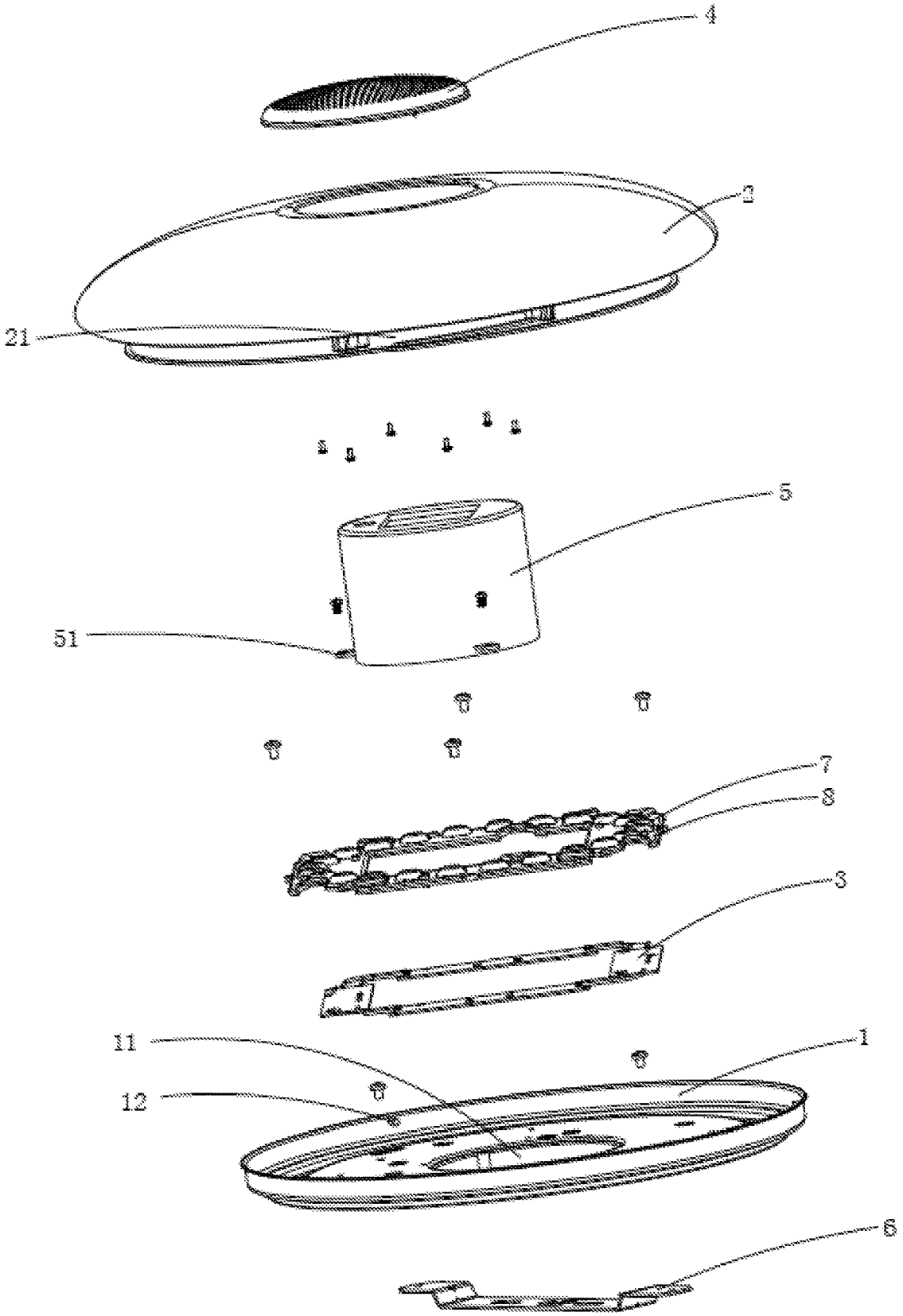
FIG. 1 illustrates an exploded view of a lighting apparatus embodiment.

Please refer to FIG. 1. FIG. 1 shows an exploded view of a lighting apparatus embodiment. In FIG. 1, a light passing cover 2 has a guiding groove 21 as the first fixing unit.

There is a speaker module 5 with protruding blocks 51 for fixing the speaker module 5 to the base plate 1. There is a circular groove 11 at a center position of the base plate 1 for installing the speaker module 5.

There is a light source module 3 covered with a lens module 7 having multiple diffusing lenses corresponding to the LED modules of the light source module 3.

A fixing plate 8 is used for fixing to the light source module 3 or to the base plate 1 depending on two different design requirements.

There are aligning columns 12 to align components during assembly of the lighting apparatus. There is a support bar 6 for fixing to a ceiling or other installation platform.

Figure 2:
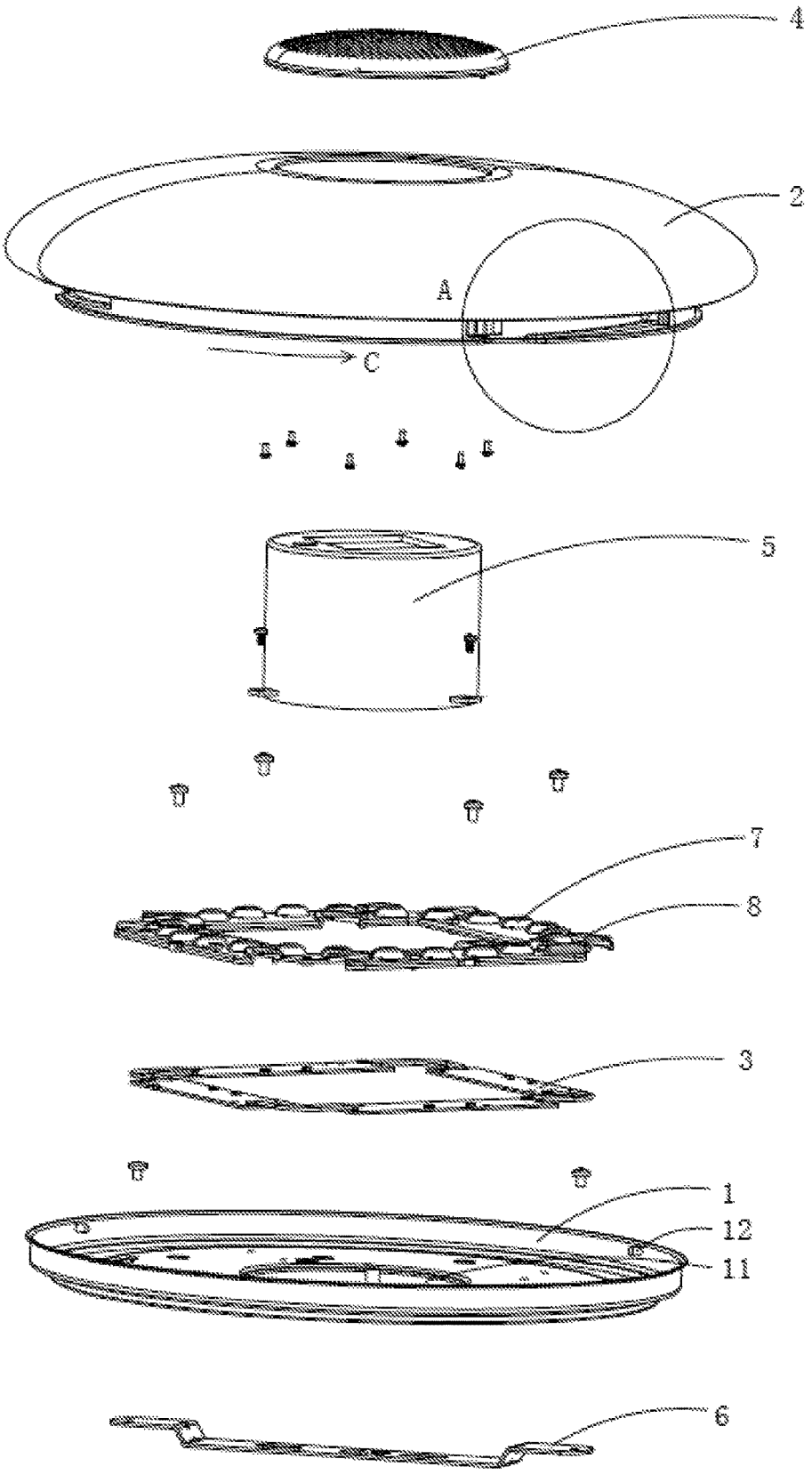
FIG. 2 illustrates another view of the exploded view of the example in FIG. 1.

Please refer to FIG. 2, which show anther view of the example in FIG. 1. All components with the same reference numerals refer to the same components and are not repeated again for brevity.

Figure 3:
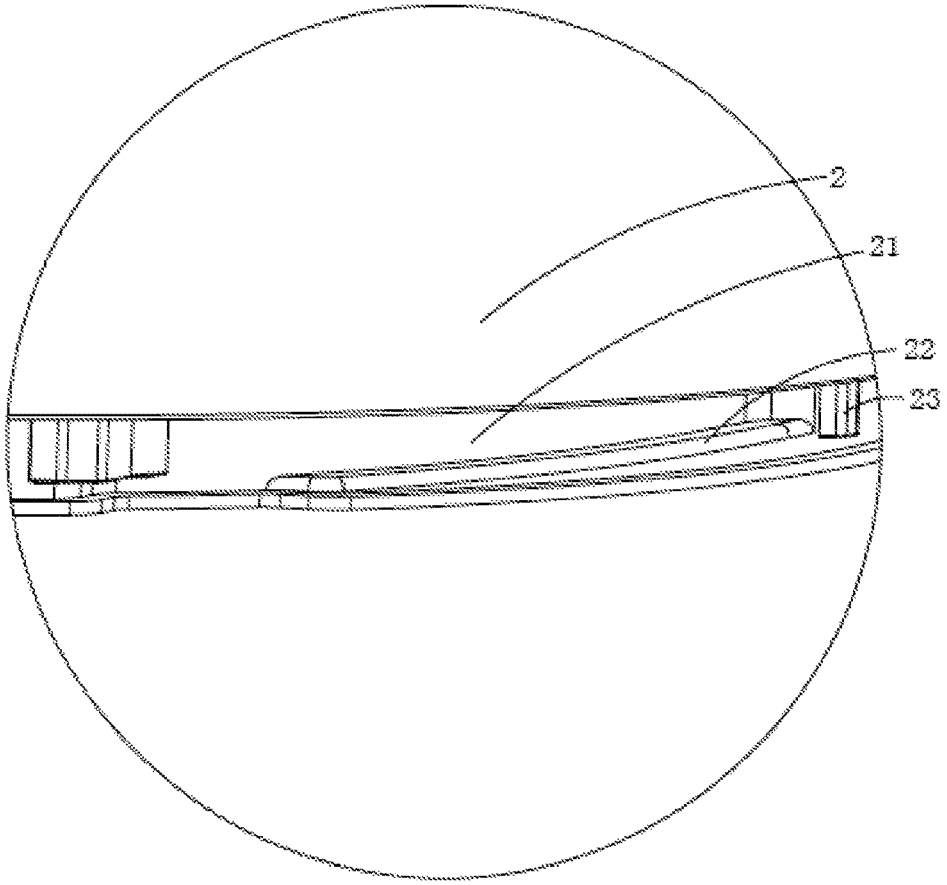
FIG. 3 illustrates a zoom-up view of a fixing unit on a light passing cover.

Please refer to FIG. 3, which shows the first fixing unit 21 of the light passing cover 2 has a guiding track 22 and a stop column 23 for fixing to the base plate.

Figure 4:
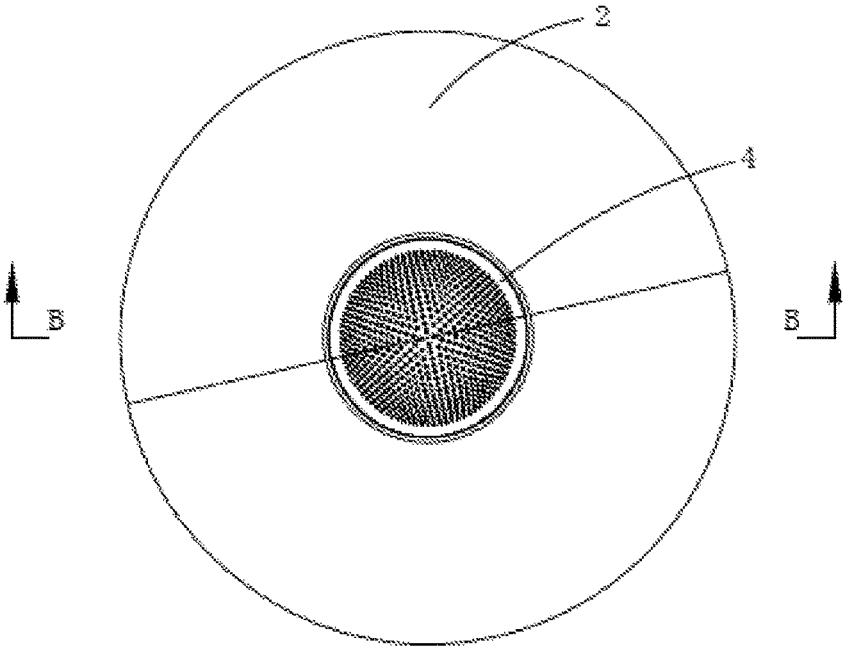
FIG. 4 illustrates a top view of a light passing cover with a speaker cover.

Please refer to FIG. 4. In FIG. 4, a speaker cover 4 is placed above the speaker module surrounding by the light passing cover 2.

Figure 5:
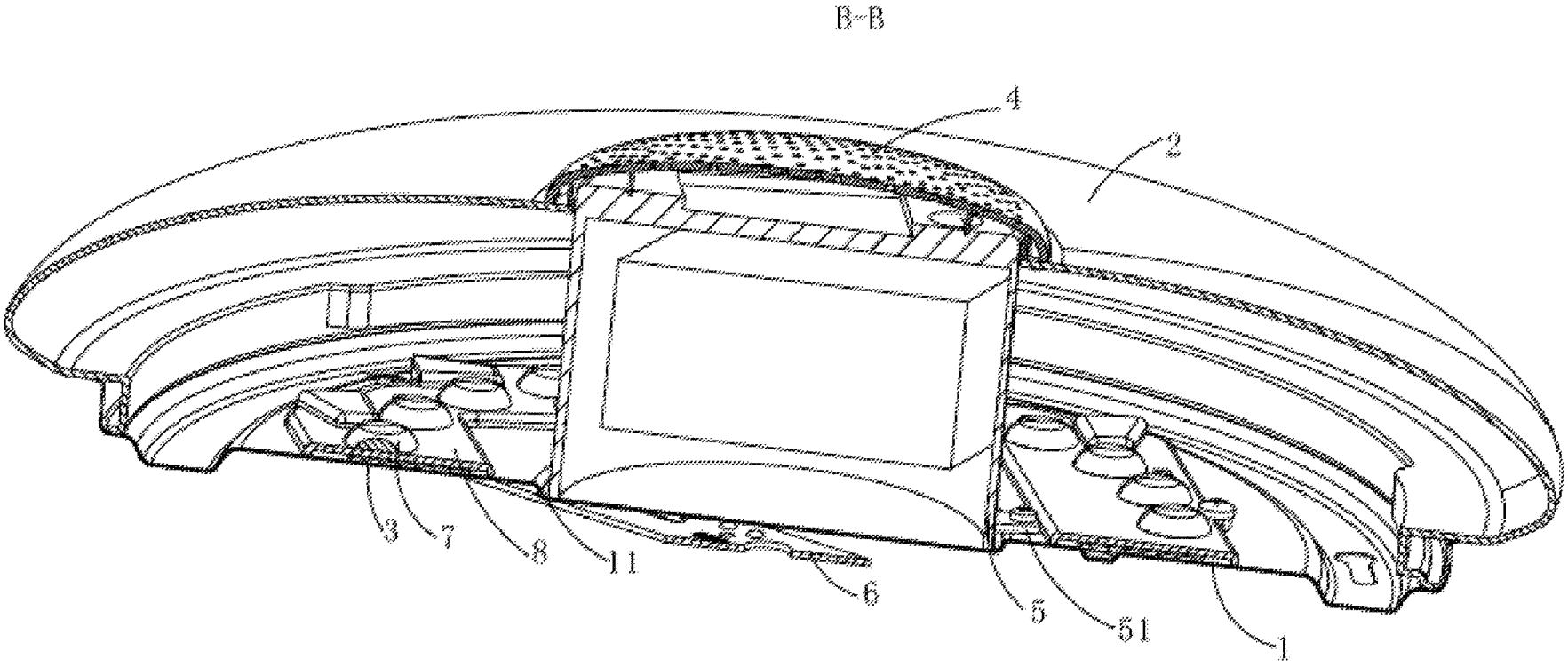
FIG. 5 illustrates a cross-sectional view of the example in FIG. 1.

Please refer to FIG. 5. FIG. 5 additionally shows another view of the component relation in the example of FIG. 1.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light passing cover with a dome shape structure, wherein the dome shape structure has a neck-in edge and neck part, the neck part has a smaller diameter than the neck-in edge, a first fixing unit is placed on the neck part;

a base plate having a ring area and a second fixing unit, wherein the second fixing unit is fixed to the first fixing unit;

a speaker module having a cylinder structure with a bottom surface and a top surface, wherein the bottom surface of the speaker module is fixed on a center position of the base plate, the top surface has an audio output end;

a light source module with multiple LED modules placed on the base plate, wherein the multiple LED modules surround the speaker module; and a lens module comprising multiple diffusing lenses respectively covering the multiple LED modules for diffusing a light of the multiple LED modules before the light passing through the light passing cover, wherein the base plate has a circular groove for fixing to the bottom surface of the speaker module.

2. The lighting apparatus of claim 1, wherein the light passing cover has a central opening on the dome structure, the top surface of the speaker module is facing to the central opening of the light passing cover.

3. The lighting apparatus of claim 2, wherein a speaker cover is fixed to the central opening of the light passing cover facing to the audio output end of the speaker module.

4. The lighting apparatus of claim 1, wherein a motion sensor is attached to the speaker module, the speaker module stops audio output if the motion sensor detects no person exists nearby over a predetermined time period.

5. The lighting apparatus of claim 4, wherein the speaker module automatically starts the audio output if the motion sensor detects a person is nearby.

6. The lighting apparatus of claim 1, wherein there is a first controller attached to the base plate for controlling the multiple LED modules and a second controller placed in the speaker module for selectively controlling the multiple LED modules.

7. The lighting apparatus of claim 6, wherein the second controller receives an external command from an external light device to control the multiple LED modules to synchronize with the external light device.

8. The lighting apparatus of claim 7, wherein the external light device has a same structure as the lighting apparatus.

9. The lighting apparatus of claim 1, wherein the light passing cover is a mesh structure, the light of the multiple LED module escape from the mesh structure.

10. The lighting apparatus of claim 1, wherein there are third fixing units disposed to the bottom surface of the speaker module to fix the speaker module to the base plate.

11. The lighting apparatus of claim 1, wherein the speaker module is fixed to a fixing bracket on an installation platform, the base plate is attached to the speaker module to indirectly fixing to the installation platform.

12. The lighting apparatus of claim 1, wherein an external power wire transmitting an external power is fixed to the speaker module, a driver of the speaker module converts the external power to a driver current supplied to the multiple LED modules.

13. The lighting apparatus of claim 12, wherein a driver in the speaker module supplies a driving current to the multiple LED modules.

14. The lighting apparatus of claim 1, wherein an external power is separately supplied to the speaker module and the light source module.

15. The lighting apparatus of claim 1, wherein a driver is fixed on the base plate, the driver converts an external power to two driving currents respectively supplied to the multiple LED modules and the speaker module.

16. The lighting apparatus of claim 1, wherein the top surface of the speaker module has a second light source for emitting a second light.

17. The lighting apparatus of claim 16, wherein the light of the LED modules rendered on the light passing cover has a first light intensity, the second light of the second light source renders a second light intensity, the ratio of the first light intensity to the second light intensity is between 70% to 130%.

18. The lighting apparatus of claim 1, wherein the multiple LED modules are placed on multiple LED light bars, the LED light bars are attached to the base plate with multiple bar connectors for receiving electricity and structure support fixing to the base plate.

19. The lighting apparatus of claim 1, wherein a support bar has a first end fixed to the installation platform and a second end fixed to the base plate, the support bar has a U shape structure corresponding to a opposite side of the circular groove.

* * * * *